US005908819A

United States Patent [19]

Reynolds et al.

[11] Patent Number: 5,908,819

[45] Date of Patent: Jun. 1, 1999

[54] AQUEOUS CLEANING COMPOSITION FOR CLEANING SUBSTRATES AND METHOD OF USING SAME

[75] Inventors: Richard Reynolds, Hightstown; Frank Cala, Highland Park, both of N.J.

[73] Assignee: Church & Dwight Co., Inc., Princeton, N.J.

[21] Appl. No.: 09/107,134

[22] Filed: Jun. 30, 1998

Related U.S. Application Data

[63] Continuation-in-part of application No. 08/852,065, May 6, 1997, Pat. No. 5,789,363.

[51] Int. Cl.[6] ..... C11D 3/28; C11D 3/33; C11D 1/66; C11D 10/02

[52] U.S. Cl. ..... 510/245; 510/174; 510/243; 510/244; 510/365; 510/461; 510/535

[58] Field of Search ..... 510/174, 243, 510/244, 365, 461, 535

[56] References Cited

U.S. PATENT DOCUMENTS

| | | | |
|---|---|---|---|
| 5,093,031 | 3/1992 | Login et al. | 252/357 |
| 5,158,710 | 10/1992 | Van Eanam | 252/539 |
| 5,160,729 | 11/1992 | Login | 424/47 |
| 5,215,675 | 6/1993 | Wilkins et al. | 252/100 |
| 5,294,644 | 3/1994 | Login et al. | 514/698 |
| 5,334,331 | 8/1994 | Fusiak | 252/542 |
| 5,435,934 | 7/1995 | Jon et al. | 252/117 |
| 5,512,071 | 4/1996 | Yam et al. | 51/307 |
| 5,789,363 | 8/1998 | Cala et al. | 510/245 |
| 5,814,588 | 9/1998 | Cala et al. | 510/175 |

*Primary Examiner*—Paul Lieberman
*Assistant Examiner*—John M. Petruncio
*Attorney, Agent, or Firm*—Irving Fishman

[57] ABSTRACT

An alkaline aqueous cleaning composition for cleaning a substrate, e.g., a plastic or metal substrate, contaminated with industrial-type soil contaminants contains (i) an aqueous portion and (ii) an active-ingredient portion composed of (A) an alkalinity-providing agent and (B) a surfactant mixture containing (a) an active concentration of an N-octyl-2-pyrrolidone surfactant and (b) an active concentration of at least one aminocarboxylic acid surfactant. The active-concentration ratio of surfactant (a) to surfactant (b) is such as to provide the cleaning composition with the ability to remove a substantial portion of the contaminants from the substrate. At an active-concentration ratio of surfactant (a) to surfactant (b) of about 2.5:1, the surfactants have a synergistic effect on the industrial-soil-removing ability of the aqueous composition. Cleaning of the substrate with the aqueous cleaning composition involves contacting the substrate with the composition for a period of time sufficient to remove at least a substantial portion of the contaminants from the substrate.

47 Claims, 3 Drawing Sheets

AQUEOUS CLEANING COMPOSITION FOR CLEANING SUBSTRATES AND METHOD OF USING SAME

This application is a continuation-in-part of U.S. patent application Ser. No. 08/852,065, filed May 6, 1997, now U.S. Pat. No. 5,789,363 assigned to the assignee of the present invention.

BACKGROUND OF THE INVENTION

This invention relates to an aqueous cleaning composition and to a method of using same to clean substrates. More particularly, this invention relates to an alkaline, aqueous cleaning/degreasing composition containing a particular combination of surfactants and to a method of using such composition to remove industrial-type soils from substrate surfaces.

Many industries, such as, for example, automobile parts repair and replacement services and the like, require that component mechanical parts be cleaned prior to inspection, repair, or replacement thereof. Generally, such parts have been exposed to various contaminants such as dirt, grease, oil, ink and the like, which must be removed for effective repair or service.

A variety of metal cleaners have been used to clean such mechanical parts. For example, solvent-based metal cleaners have been used which contain either halogenated or non-halogenated hydrocarbons. Aqueous-based, highly alkaline detergent systems have also been used to clean metal parts. However, the use of such solvent-based or aqueous-based cleaners has raised environmental and/or worker safety concerns.

For example, although halogenated hydrocarbon solvents such as chlorofluorocarbons (CFCs), trichloromethane, methylene chloride and trichloroethane (methyl chloroform) have been widely used in industry for metal cleaning, the safety, environmental and cost factors associated with their use coupled with waste disposal problems are negative aspects of the use of such solvents. A world-wide and U.S. ban on most halogenated solvents is soon in the offing by virtue of the Montreal Protocol, Clean Air Act and Executive and Departmental directives.

Non-halogenated hydrocarbon solvents such as toluene, Stoddard solvent and like organic compounds such as ketones and alcohols are generally flammable and highly volatile and have dubious ability to be recycled for continuous use. These factors, along with unfavorable safety, environmental and cost factors, make the non-halogenated hydrocarbon solvents unattractive for practical consideration. For example, the most useful organic solvents, classified as volatile organic compounds (VOCs), pollute the atmosphere, promote formation of a toxic zone at ground level, and add to the inventory of greenhouse gases.

Aqueous cleaning systems have been developed to overcome some of the inherent negative environmental and health aspects associated with the solvent-based cleaning systems. Unfortunately, aqueous cleaning systems also have drawbacks.

For example, aqueous cleaners containing sodium hydroxide or organic solvents such as alkanolamine, ethers, alcohols, glycols and the like, tend to be exceedingly alkaline, i.e., having pHs of 13 and above. These exceedingly alkaline aqueous solutions are highly corrosive to metal surfaces, highly toxic and can be dangerous to handle, thus requiring extreme safety measures to avoid contact with the skin. The organic solvent-containing aqueous cleaners have the toxicity and environmental problems discussed previously herein.

Although the exceedingly alkaline aqueous cleaners have the aforementioned drawbacks, it has been most difficult to obtain an aqueous detersive solution which has a moderate pH (i.e., less than about 12.0) and which is effective in removing grease and oil contaminants from substrates, e.g., metal engine parts, and which would not be corrosive to metal substrates.

A primary object of this invention is to provide an alkaline aqueous cleaning composition which has a moderate pH and which effectively removes industrial-type soil contaminants from substrates.

Another object of this invention is to provide an alkaline aqueous cleaning composition having a moderate pH and which effectively removes industrial-type soil contaminants from a metal substrate without being excessively corrosive to the metal substrate.

A further object of this invention is to provide an alkaline aqueous cleaning composition having a moderate pH and which effectively removes industrial-type soil contaminants from a substrate, wherein the cleaning composition is not irritating to human skin and is less toxic upon accidental ingestion than are organic-based solvent systems.

Still another object of this invention is to provide a method of cleaning substrates by means of an alkaline aqueous cleaning composition having the properties described in the foregoing objects.

These and other objects which are achieved according to the present invention can be readily discerned from the following description.

SUMMARY OF THE INVENTION

The present invention is based in part on the discovery that in an alkaline aqueous composition, the presence of a surfactant mixture composed specifically of an N-octyl-2-pyrrolidone surfactant and an aminocarboxylic acid surfactant of formula (I) set forth below will provide the aqueous alkaline composition with excellent cleaning abilities, particularly with respect to removing industrial-type soil contaminants from substrates such as plastic and metal substrates. This is true even when the aqueous alkaline composition is moderately alkaline.

The present invention is further based on the discovery that at a particular active-concentration ratio relative to one another, the N-octyl-2-pyrrolidone surfactant and the aminocarboxylic acid surfactant of formula (I) below will have a synergistic effect on the industrial-soil removing properties of the aqueous cleaning composition.

Accordingly, one aspect of the present invention is directed to an aqueous alkaline cleaning composition for cleaning a substrate contaminated with industrial-type soil contaminants, containing:

(i) an aqueous portion and (ii) an active-ingredient portion composed of:

(A) an alkalinity-providing agent in an amount sufficient to provide the aqueous cleaning composition with an alkaline pH;

(B) a surfactant mixture containing:

(a) an active concentration of an N-octyl-2-pyrrolidone surfactant, and (b) an active concentration of at least one aminocarboxylic acid surfactant of the general formula:

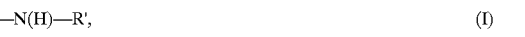

R—N(H)—R', (I)

wherein R is a straight or branched chain aliphatic organic group having from 10 to 20 carbon atoms, preferably from 12 to 18 carbon atoms, and R' is a straight or branched chain carboxylic acid having from 2 to 10 carbon atoms, preferably from 2 to 4 carbon atoms;

wherein the active concentration of surfactant (a) and the active concentration of surfactant (b) are such as to render the aqueous cleaning composition capable of removing at least a substantial portion of the contaminants from the substrate.

A further aspect of this invention is directed to a non-aqueous cleaning composition composed of the active-ingredient portion of the aqueous cleaning composition. Such non-aqueous cleaning composition can be combined with an aqueous medium to form the aqueous cleaning composition of this invention.

Still another aspect of this invention is directed to the surfactant mixture used in the active-ingredient portion of the aqueous cleaning composition of this invention.

Another aspect of the present invention is directed to a method of cleaning a substrate contaminated with industrial-type soil contaminants, involving the steps of:

(1) providing the aqueous cleaning composition of this invention, and (2) contacting the contaminated substrate with the aqueous cleaning composition for a period of time sufficient to remove at least a substantial portion of the contaminants from the substrate.

One advantage of the present invention is that it provides an aqueous cleaning composition which, even at a moderately alkaline pH, is capable of effectively removing industrial-type soil contaminants from a substrate.

Another advantage of the present invention is that it provides a surfactant combination which renders the aqueous cleaning composition capable of effectively removing the industrial-type soil contaminants from the substrate.

Still another advantage of the present invention is that, at a particular active-concentration ratio relative to one another, the surfactants used in the surfactant mixture synergistically affect the cleaning properties of the aqueous cleaning composition.

A further advantage of the present invention is that the aqueous cleaning composition provided thereby is not exceedingly corrosive to metal substrates or irritating to human skin and, further, is less toxic upon accidental ingestion than are organic-based solvent systems.

DETAILED DESCRIPTION OF THE INVENTION

Figure 1:
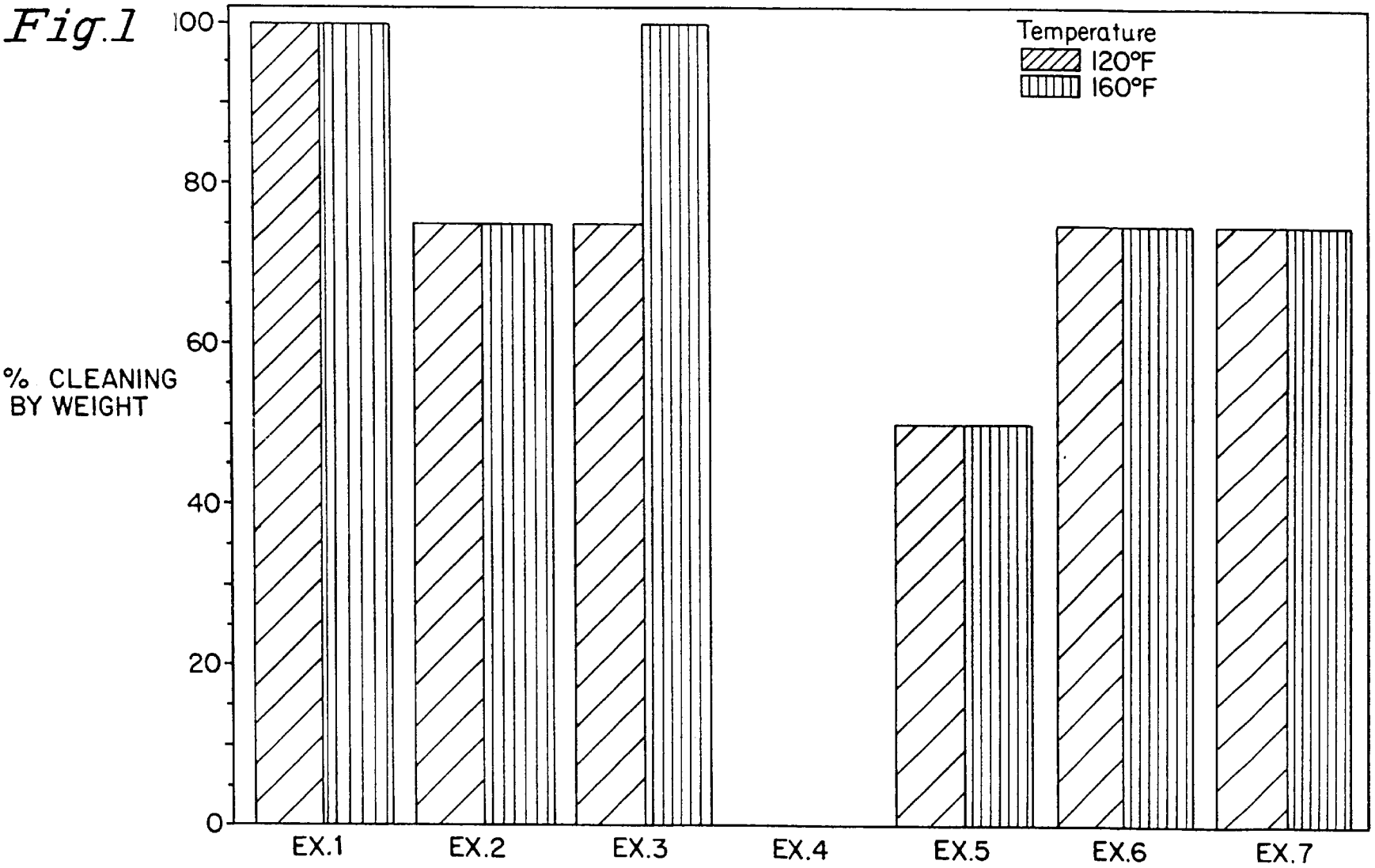
FIG. 1 is a graph showing the amount of ink contaminants removed from a metal substrate by means of the aqueous cleaning compositions prepared in Examples 1–3 and Comparison Examples A–D herein.

As stated hereinabove, the present invention provides an aqueous cleaning composition capable of removing industrial-type soil contaminants from a substrate. The invention further provides a method of removing such contaminants from a substrate by means of the aqueous cleaning composition of this invention.

The cleaning composition may be used to clean any substrate on which industrial-type soil contaminants are disposed. Preferably, the cleaning composition is used to clean metal or plastic substrates. Non-limiting examples of metal substrates which can be cleaned by means of the aqueous composition of this invention include, e.g., iron-based metal substrates such as iron, iron alloys, e.g., steel, tin, aluminum, copper, tungsten, titanium, molybdenum, and the like. The structure of the metal substrate to be cleaned can vary widely and is unlimited. Thus, the metal substrate can be as a metal part of complex configuration, sheeting, coils, rolls, bars, rods, plates, disks, and the like. Such metal components can be derived from any source including for home use, for industrial use such as from the aerospace industry, automotive industry, electronics industry, and the like, wherein the metal surfaces have to be cleaned. A non-limiting example of a plastic substrate which can be cleaned in accordance with the present invention is a Lexan® polycarbonate substrate.

As used herein, the term "industrial-type soil contaminants" refers to such contaminants as greases, cutting fluids, drawing fluids, machine oils, anti-rust oils such as cosmoline, carbonaceous soils, sebaceous soils, particulate matter, waxes, paraffins, used motor oils, fuels, printing inks, mixed-lube products, and the like.

The aqueous cleaning composition of this invention is capable of removing at least a substantial portion of the industrial-type soil contaminants from the substrate. The term "at least a substantial portion" with respect to the amount of contaminants removed from the substrate generally refers to an amount of from about 50% to about 100% by weight.

The aqueous cleaning composition of this invention is alkaline and preferably has a pH of less than about 12.0, more preferably from about 8.0 to about 11.0, and most preferably from about 8.0 to about 10.0. The composition contains an aqueous portion and an active-ingredient portion, wherein the aqueous portion preferably consists essentially of water and the active-ingredient portion contains an alkalinity-providing agent and a surfactant mixture. The surfactant mixture is composed of (a) an active concentration of the aforementioned N-octyl-2-pyrrolidone surfactant and (b) an active concentration of the aforementioned aminocarboxylic acid surfactant(s) of formula (I). The active concentrations of surfactants (a) and (b) are such as to render the cleaning composition capable of removing at least a substantial portion of the industrial-type soil contaminants from the substrate.

With respect to surfactants (a) and (b), the term "active concentration" refers to the concentration of the active form of the surfactants. For example, the N-octyl-2-pyrrolidone surfactant is typically provided as a 100% active surfactant formulation. Thus, the active concentration of such N-octyl-2-pyrrolidone surfactant in a composition will be equal to the amount of such surfactant added to the composition. On the other hand, an N-coco-beta-aminopropionic acid surfactant is generally provided as a 40% active surfactant formulation. Thus, the active concentration of such N-coco-beta-aminopropionic acid surfactant in a composition will be equal to 40% of the amount of such surfactant added to the composition.

As was mentioned previously herein, at a particular active-concentration ratio relative to one another, the N-octyl-2-pyrrolidone surfactant and the aminocarboxylic acid surfactant(s) of formula (I) will have a synergistic effect on the ability of the aqueous cleaning composition to remove industrial-type soil contaminants from a substrate. With respect to surfactants (a) and (b), the term "active-concentration ratio" refers to the ratio of the active concentrations of surfactants (a) and (b) relative to one another.

The alkalinity-providing agent(s) present in the aqueous cleaning compositions of this invention can be one or more alkaline salts. Suitable alkaline salts or mixtures thereof are those capable of providing the desired pH. Most suitable are the salts of potassium and sodium. Especially preferred are the potassium and sodium carbonates and bicarbonates, which are safe, economical and environmentally friendly. The carbonate salts include, e.g., potassium carbonate, potassium carbonate dihydrate, potassium carbonate trihydrate, sodium carbonate, sodium carbonate decahydrate, sodium carbonate monohydrate, sodium sesquicarbonate and the double salts and mixtures thereof. The bicarbonate salts include potassium bicarbonate and sodium bicarbonate and mixtures thereof. Mixtures of the carbonate and bicarbonate salts are also especially useful.

Although not preferred, other suitable alkaline salts which can be used as the alkalinity-providing agent include the alkali metal ortho or complex phosphates. The complex phosphates are especially effective because of their ability to chelate water hardness and heavy metal ions. The complex phosphates includes, for example sodium or potassium pyrophosphate, tripolyphosphate and hexametaphosphates.

Additional suitable alkaline salts useful as the alkalinity-providing agent include the alkali metal borates, acetates, citrates, tartrates, succinates, silicates, phosphonates, edates, etc.

In particularly preferred embodiments of the present invention, the alkalinity-providing agent is a mixture of potassium carbonate and potassium bicarbonate or a mixture of potassium carbonate and sodium carbonate.

The alkalinity-providing agent is present in the aqueous cleaning composition of this invention in an amount sufficient to provide the composition with an alkaline pH, preferably a moderately alkaline pH such as a pH within the preferred pH ranges recited previously herein, i.e., preferably less than about 12.0, more preferably from about 8.0 to about 11.0, most preferably from about 8.0 to about 10.0. Preferably, the active-ingredient portion of the cleaning composition of this invention contains from about 20% to about 80% by weight of the alkalinity-providing agent. In particularly preferred embodiments of the present invention, the active-ingredient portion contains (i) about 10.0% by weight of potassium carbonate and about 50.0% by weight potassium bicarbonate or (ii) about 50% by weight of potassium carbonate and about 10.0% by weight of sodium carbonate.

As stated above, the aqueous cleaning composition of this invention preferably has a moderately alkaline pH. Because the pH thereof is moderately alkaline, the aqueous cleaning composition of this invention is substantially less harmful to use and handle than highly alkaline aqueous cleaners such as those formed from sodium hydroxide or aqueous alkanol amine solutions. In addition, a moderately alkaline pH level allows the aqueous cleaning composition of this invention to effectively remove industrial-type soil contaminants from a substrate without burning or irritating human skin or corroding the substrate if the substrate is metal.

The active-ingredient portion of the aqueous cleaning composition of this invention contains a surfactant mixture composed of (a) an active concentration of the aforementioned N-octyl-2-pyrrolidone surfactant and (b) an active concentration of the aminocarboxylic acid surfactant(s) of formula (I). The active concentration of the N-octyl-2-pyrrolidone surfactant (i.e., "surfactant (a)") and the active concentration of the aminocarboxylic acid surfactant(s) (i.e., "surfactant (b)") relative to one another in the active-ingredient portion and in the aqueous cleaning composition of this invention are such as to render the aqueous cleaning composition capable of removing at least a substantial portion of the industrial-type soil contaminants from the substrate. Preferably, the active concentrations of surfactants (a) and (b) are such as to provide an active concentration ratio of surfactant (a) to surfactant (b) of from about 5:1 to about 1:1, most preferably about 2.5:1.

As stated hereinabove, at a particular active-concentration ratio relative to one another, surfactants (a) and (b) have a synergistic impact on the industrial-soil removing abilities of the aqueous cleaning composition. Such synergism has been found to occur when the active-concentration ratio of surfactant (a) to surfactant (b) is about 2.5:1.

A suitable N-octyl-2-pyrrolidone surfactant for use in the present invention is commercially available under the designation "ISP Surfadone LP-100" from International Specialty Products.

As mentioned hereinabove, the aminocarboxylic acid surfactant(s) used in the present invention has the general formula:

$$R—N(H)—R'. \quad (I)$$

In formula (I), R is a straight or branched chain aliphatic organic group having from 10 to 20 carbon atoms, preferably from 12 to 18 carbon atoms, and R' is a straight or branched chain carboxylic acid having from 2 to 10 carbon atoms, preferably from 2 to 4 carbon atoms. Preferably, R' is a 1-carboxy-2-yl group. In preferred embodiments, the aminocarboxylic acid surfactant(s) used in this invention is N-coco-beta-aminopropionic acid surfactant. A particularly suitable N-coco-beta-aminopropionic acid for use in this invention is commercially available from Henkel Corporation under the designation "Deriphat 151-C", which is an amphoteric surfactant. The Deriphat 151-C surfactant is provided in 40% active form.

The surfactant mixture used in the present invention may contain one aminocarboxylic acid surfactant of formula (I) or a mixture of such aminocarboxylic acid surfactants, particularly a mixture of such surfactants wherein the various aminocarboxylic acid surfactants in the mixture contain different R groups.

The active-ingredient portion of the aqueous cleaning composition of this invention optionally further contains a dioctyl dipropionate compound. Such compound has been found to enhance oil-splitting and to hydrotrope the surfactants without aid from other surfactants. If used, the dioctyl dipropionate is preferably present in the composition of this invention in an amount effective to achieve the foregoing functions.

In addition, the active-ingredient portion of the composition of this invention may further contain one or more additives conventionally used in aqueous cleaning compositions.

For example, the active-ingredient portion of the composition of this invention may further contain one or more hydrotropes. Hydrotropes tend to keep surfactants readily dispersed in aqueous compositions.

Suitable hydrotropes for use in this invention include the sodium, potassium, ammonium, and alkanol ammonium salts of xylene, toluene, ethylbenzoate, isopropylbenzene, naphthalene, alkyl naphthalene sulfonates, phosphate esters of alkoxylated alkyl phenols, phosphate esters of alkoxylated alcohols and sodium, potassium and ammonium salts of the alkyl sarcosinates.

A particularly preferred hydrotrope for use in the present invention is one that does not foam. Among the most useful of such hydrotropes are the alkali metal salts of intermediate chain length (i.e., $C_7$–$C_{13}$) monocarboxylic fatty acids. The most preferred of these hydrotropes are the alkali metal octanoates and nonanoates.

The active-ingredient portion of the cleaning composition of this invention may further contain one or more polymeric anti-precipitating agents. Such agents prevent precipitation of water hardness salts and insoluble silicates formed during reaction with the alkaline salts of the cleaning composition of this invention. By preventing such precipitation, the anti-precipitating agents also prevent scaling caused by such precipitation.

Anti-precipitating agents suitable for use in the present invention may be generically categorized as water-soluble carboxylic acid polymers or as vinyl addition polymers. Polyacrylates are especially preferred as the anti-precipitating agent. Of the vinyl addition polymers contemplated, maleic anhydride copolymers as with vinyl acetate, styrene, ethylene, isobutylene, acrylic acid and vinyl ethers are preferred.

All of the above-described polymeric anti-precipitating agents are water-soluble or at least colloidally dispersible in water. The molecular weight of these polymers may vary over a broad range although it is preferred to use polymers having average molecular weights ranging between 1000 up to 1,000,000, more preferably 100,000 or less and, most preferably, between 1000 and 10,000. While higher molecular weight polymers may be used, there is no particular advantage in their use because they tend to be broken down due to the shear forces found in recirculating cooling systems. Also, when used in larger amounts in concentrated formulas, the higher molecular weight polymers tend to produce highly viscous products which are difficult to use.

The most preferred anti-precipitating agents for use in the composition of this invention are polycarboxylates.

The active-ingredient portion of the aqueous cleaning composition of this invention preferably contains from about 20% to 80 by weight of the alkalinity-providing agent, from about 80% to about 20% by weight of the surfactant mixture, from 0% to about 10% by weight of at least one anti-precipitating agent, and from 0% to about 30% by weight of at least one hydrotrope, wherein the active-concentration ratio of the N-octyl-2-pyrrolidone surfactant to the aminocarboxylic acid surfactant(s) preferably ranges from about 1:1 to about 5:1, most preferably about 2.5:1. If the alkalinity-providing agent is the preferred carbonate and bicarbonate salts, the combination of such salts should be present in the amounts of 20–80 weight percent. Preferably, if such a mixture is used, the amount of bicarbonate salts should comprise from about 5 to about 80 weight percent and the carbonate salts from about 5 to about 60 weight percent based on the weight of the active-ingredient portion of the cleaning composition.

The aqueous portion of the cleaning composition of this invention preferably consists essentially of water, preferably water which has been deionized, distilled or purified by reverse osmosis treatment and the like.

The aqueous portion may further contain one or more organic solvents, such as, e.g., hydrocarbon, halohydrocarbon, and oxygenated hydrocarbon solvents. However, preferred embodiments of the aqueous cleaning composition of this invention are free of organic solvents.

The aqueous cleaning compositions of this invention can be in the form of a concentrate or in the form of a solution. In concentrate form, the cleaning composition preferably contains from about 5% to about 45% of the active-ingredient portion and from about 55% to about 95% by weight of the aqueous portion. More preferably, the concentrate contains from about 5% to about 20% by weight of the active-ingredient portion and from about 80% to about 95% by weight of the aqueous portion. In solution form, the composition preferably contains from about 0.1% to about 20% by weight of the active-ingredient portion and from about 80% to about 99.9% by weight of the aqueous portion. More preferably, the solution contains from about 0.2% to about 5% by weight of the active-ingredient portion and from about 95% to about 99.8% by weight of the aqueous portion.

Another aspect of the present invention is directed to the active-ingredient portion of the cleaning composition of this invention. Thus, this aspect of the invention is directed to a non-aqueous, active-ingredient composition capable of being combined with an aqueous medium to form an aqueous cleaning composition, wherein the active-ingredient composition is composed of (A) the aforementioned alkalinity-providing agent in an amount sufficient to provide the aqueous composition with an alkaline pH and (B) the aforementioned surfactant mixture containing (a) an active concentration of the aforementioned N-octyl-2-pyrrolidone surfactant and (b) an active concentration of at least one aminocarboxylic acid surfactant of formula (I), wherein the active concentration of surfactant (a) and the active concentration of surfactant (b) are such as to render the aqueous composition capable of removing at least a substantial portion of industrial-type soil contaminants from a substrate contaminated therewith.

Another aspect of this invention is directed to the surfactant mixture used in the aqueous cleaning composition of this invention. Specifically, this aspect of the invention is directed to a surfactant mixture for use in an alkaline, aqueous composition containing an alkalinity-providing agent, wherein the surfactant mixture contains (a) an active concentration of the aforementioned N-octyl-2-pyrrolidone surfactant and (b) an active concentration of the aminocarboxylic acid surfactant(s) of formula (I), wherein the active concentration of surfactant (a) and the active concentration of surfactant (b) are such as to render the aqueous composition capable of removing at least a substantial portion of industrial-type soil contaminants from a substrate contaminated therewith. Preferably, the active concentrations of the surfactants are such as to provide an active-concentration ratio of the N-octyl-2-pyrrolidone to the aminocarboxylic acid surfactant(s) of from about 5:1 to about 1:1, most preferably about 2.5:1.

The present invention is also directed to a method of removing industrial-type soil contaminants from a substrate contaminated therewith. The method of this invention involves:

(1) providing the aqueous cleaning composition of this invention; and (2) contacting the contaminated substrate with the aqueous cleaning composition for a period of time sufficient to remove at least a substantial portion of the contaminants from the substrate.

Preferably, the contaminated substrate is contacted with the aqueous cleaning composition for a period of time sufficient to remove substantially all of the contaminants from the substrate, i.e., to render the substrate substantially free of contaminants. Such period of time will vary depending upon the degree of contamination but broadly will range from about 1 minute to about 30 minutes, with 3 to 15 minutes being more typical.

Furthermore, the contacting of the contaminated substrate with the aqueous cleaning composition of this invention is preferably carried out at an elevated temperature, preferably a temperature of from about 90° F. to about 180° F., more preferably from about 120° F. to about 160° F.

The aqueous cleaning compositions of this invention are useful in removing a variety of industrial-type soil contaminants from substrates. As mentioned previously, such contaminants include, e.g., greases, cutting fluids, drawing fluids, machine oils, antirust oils such as cosmoline, mixed-lube products, carbonaceous soils, sebaceous soils, particulate matter, waxes, paraffins, used motor oil, fuels, printing inks, and the like.

The cleaning composition of this invention is particularly useful in cleaning engine parts which are contaminated with grease and/or oil. The cleaning of such metal parts is preferably conducted in a parts washer, wherein the metal parts are contacted with the solution form of the cleaning composition of this invention. The parts are contacted with such solution either by immersion or by some type of impingement in which the aqueous cleaning solution is circulated continuously on the metal part or is sprayed thereon. Alternatively, agitation can be provided as ultrasonic waves. The cleaning solution is then filtered and recycled for reuse in the parts washer.

The following examples illustrate but do not limit the present invention.

Experimental

The Examples below illustrate the cleaning abilities of aqueous compositions within the scope of the present invention and those of various aqueous compositions outside the scope of the present invention. Specifically, the Examples illustrate the ability of the aqueous compositions to remove certain types of industrial soils from metal and plastic substrates.

Three types of industrial soils were used in the EXAMPLES. These are set forth below:

Soil #1—lithium grease

Soil #2—black permanent writing ink

Soil #3—a mixed lube composed of 64% by weight of lithium grease (the same type used as Soil #1), 34% by weight of Aeroshell Oil W 80 Shell Oil (available from Shell), and 2% by weight of carbon black.

The metal substrate used in Examples 1–8 and 10–16 and in Comparison Examples A–S was a metal coupon (1"×1") composed of a Kovar metal alloy having the following composition:

Fe 69.978% by weight
Ni 29.14% by weight
Al 0.007% by weight
C 0.012% by weight
Cu 0.12% by weight
Cr 0.19% by weight
Mn 0.23% by weight
Mb 0.16% by weight
P 0.002% by weight
S 0.001% by weight
Si 0.13% by weight
Ti 0.03% by weight In each Example, the ability of the composition prepared therein to remove industrial soil contaminants from the surface of the metal coupon was determined by means of the test procedure described below.

Each metal coupon was cleaned by means of hexane immersion and wipe, followed by an acetone bath. After cleaning, the coupons were dried in an oven at about 85° C. for about 15 minutes and then cooled in a desiccator for about 15 minutes. A plastic beaker was placed upside down in an analytical balance and tare, and a polypropylene hemostat was placed on top of the beaker and tare. The cooled coupon was then placed in the hemostat by a corner thereof and weighed. The weight of the coupon measured at this point was designated as "Wt. A". The coupon was then removed from the balance and a thin, even layer of soil was brushed onto both sides of the coupon such that the soil covered the lower 75% of the coupon but did not contact the hemostat. The soiled coupon was then placed back on the beaker in the balance and weighed. Its weight at this point was designated as "Wt. B".

The cleaning compositions set forth in the Examples herein were each prepared by combining, in a Fleaker™ container equipped with a stirrer, sufficient amounts of water and dry ingredients to form a 10% v/v diluted solution, stirring the solution at about 600 rpms and heating the blend to an appropriate temperature. When the solution had reached its target temperature, the coupon was placed in the beaker such that the hemostat handles held the coupon in solution by resting on the rim of the Fleaker™ container. The coupon was washed in the solution for a given period of time. After the wash time was complete, the coupon was removed from the solution and rinsed quickly in a beaker of distilled water. The rinsed coupon (while still on the hemostat) was dried in an oven at about 85° C. for about 20 minutes. The coupon was then removed from the oven and allowed to cool in air for about 15 minutes. After it was cooled, the coupon was weighed alone in the analytical balance. The weight of the coupon at this stage was designated as "Wt. C".

The cleaning efficacy of the cleaning solutions prepared in the Examples was measured on the basis of the percentage of soil removed in the above-described test procedure. Specifically, the percent cleaning efficacy of the solutions was calculated using the following formula:

$$\{[(Wt.B-Wt.A)-(Wt.C-Wt.A)]/(Wt.B-Wt.A)\}\times 100$$

The foregoing test procedure was used in its entirety when the industrial soil to be removed was grease or a mixed lube. However, when the soil was ink, no weighing was done. Instead, the cleaning efficacy of the solutions with respect to ink-removal was determined by visual observation. The following scale was used to describe the extent of ink-removal observed:

0=no removal (0%)
1=light removal (about 25%)
2=moderate removal (about 50%)
3=heavy removal (about 75%)
4=complete removal (100%)

EXAMPLES 1–3 and COMPARISON EXAMPLES A–F

In Examples 1–3 and Comparison Examples A–F, nine (9) aqueous cleaning solutions were prepared, having the formulations set forth in Table I below. The solutions prepared in Examples 1–3 were within the scope of the present invention. In Table I, the concentrations recited for the active ingredients represent the active concentrations of these ingredients.

The following terms used in Table I have the following meanings:

"Pot.Carb."—potassium carbonate

"Sod.Carb."—sodium carbonate

"115-C"—N-coco beta-aminopropionic acid (available from Henkel Corporation under the designation "Deriphat-151-C")

"LP-100"—N-octyl-2-pyrrolidone (available from International Specialty Products under the designation "ISP Surfadone LP-100".

TABLE I

Examples 1–3 and Comparison Examples A–F: Formulations

| Ingredient | Example No. Concentration (Weight %) | | |
|---|---|---|---|
| | 1 | 2 | 3 |
| Water | 90.50 | 91.00 | 89.00 |
| Pot. Carb. | 1.00 | 1.00 | 1.00 |
| Pot. Bicarb. | 5.00 | 5.00 | 5.00 |
| LP-100 | 2.50 | 2.50 | 2.50 |
| 151-C | 1.00 | 0.50 | 2.50 |
| | A | B | C |
| Water | 93.00 | 91.50 | 92.00 |
| Pot. Carb. | 1.00 | 1.00 | 1.00 |
| Pot. Bicarb. | 5.00 | 5.00 | 5.00 |
| LP-100 | 0.00 | 2.50 | 0.00 |
| 151-C | 1.00 | 0.00 | 2.00 |
| | D | E | F |
| Water | 89.00 | 90.50 | 90.50 |
| Pot. Carb. | 1.00 | 1.00 | 1.00 |
| Pot. Bicarb. | 5.00 | 5.00 | 5.00 |
| LP-100 | 5.00 | 3.50 | 0.00 |
| 151-C | 0.00 | 0.00 | 3.50 |

The ink-removing and mixed-lube-removing abilities of the solutions prepared in Examples 1–3 and Comparison Examples A–F were determined by the test procedures described previously herein. In addition, the grease-removing abilities of the solutions prepared in Examples 1–3 and Comparison Examples A–D were measured in accordance with the test procedure described hereinabove. In each example, the ink-removing abilities and mixed-lube-removing abilities of the cleaning solution were measured at two temperatures, i.e., 120° F. and 160° F. In Examples 1–3 and Comparison Examples A–D, the grease-removing abilities were also measured at 120° F. and 160° F.

The visually observed ink-removal results for the solutions are set forth in Table II and in FIG. 1.

TABLE II

Examples 1–3 and Comparison Examples A–F: Ink Removal Results

| Example No. | Scale Value 120° F. | Scale Value 160° F. |
|---|---|---|
| 1 | 4 | 4 |
| 2 | 3 | 3 |
| 3 | 3 | 4 |
| A | 0 | 0 |
| B | 2 | 2 |
| C | 3 | 3 |

TABLE II-continued

Examples 1–3 and Comparison Examples A–F: Ink Removal Results

| Example No. | Scale Value 120° F. | Scale Value 160° F. |
|---|---|---|
| D | 3 | 3 |
| E | 3 | 3 |
| F | 2 | 2 |

As can be seen from Table II above and FIG. 1, the Example 1 solution, containing the LP-100 surfactant at an active concentration of 2.5% by weight and the 151-C surfactant at an active concentration of 1.0% by weight (i.e., an LP-100:151-C surfactant active-concentration ratio of 2.5:1) was able to remove 100% of the ink contaminants from the metal coupon used in the example. This result is surprising since the Example A solution, containing 1.0% by weight of the 151-C surfactant and none of the LP-100 surfactant, was not able to remove any of the ink contaminants from the metal coupon therein, while the Example B solution, which contained 2.5% by weight of the LP-100 surfactant and none of the 151-C surfactant, removed 75% of the ink contaminants from the metal coupon therein. It would be expected in view of the results of Examples A and B that a combination of 1.0% by weight of the 151-C surfactant and 2.5% by weight LP-100 surfactant would result in the removal of somewhere between 0% and 75% of the ink contaminants from the metal coupon. However, Example 1 shows that such a combination results in the removal of 100% of the ink contaminants. Thus, Example 1 clearly shows that, at an LP-100:151-C surfactant active-concentration ratio of 2.5:1, the LP-100 and 151-C surfactants have a synergistic effect on the cleaning solution's ability to remove the ink contaminants from the metal coupon.

The ink-removing ability of the Example 1 solution is also surprising in view of the ink-removing abilities of the solutions prepared in Comparative Examples E and F. The solution prepared in Comparative Example E contained 3.5% of the LP-100 surfactant and none of the 151-C surfactant, while the solution prepared in Comparative Example F contained 3.5% of the 151-C surfactant and none of the LP-100 surfactant. The solution of Comparative Example E removed 75% by weight of the ink at both 120° F. and 160° F. The solution of Comparative Example F removed 50% of the ink at 120° F. and about 58% of the ink at 160° F. As stated above, the solution of Example 1 removed 100% of the ink at both 120° F. and 160° F. The ink-removing ability of the Example 1 is surprising since it would be expected in view of the results of Comparative Examples E and F that a combination of the 151-C and LP-100 surfactants would result in the removal of somewhere between about 58% and 75% of the ink contaminants from the metal coupon. However, Example 1 shows that the combination of the LP-100 and 151-C surfactants therein results in the removal of 100% of the ink contaminants. Thus, Example 1 shows that the combination of the LP-100 and 151-C surfactants therein has a synergistic effect on the cleaning solution's ability to remove the ink contaminants from the metal coupon.

The Example 2 solution, which contained 2.50% by weight of the LP-100 surfactant and 0.50% by weight of the 151-C surfactant (i.e., an LP-100:151-C surfactant active-concentration ratio of 5.0:1) did not remove as much of the ink contaminants as did the Example 1 solution, but did remove a substantial amount, specifically 75% by weight, of the ink contaminants at both 120° F. and 160° F. Thus, the Example 2 solution exhibited good ink-removing abilities.

The Example 3 solution, which contained 2.50% by weight of the LP-100 surfactant and 2.50% by weight of the 151-C surfactant (i.e., an LP-100:151-C surfactant active-concentration ratio of 1:1) removed 75% of the ink contaminants at 120° F. and 100% of the ink contaminants at 160° F. Thus, the Example 3 solution also had good to excellent ink-removing abilities.

The Example C solution, which contained 2.00% by weight of the 151-C surfactant but none of the LP-100 surfactant, removed 75% of the ink contaminants at both 120° F. and 160° F. The Example A solution, which contained 1.00% by weight of the 151-C surfactant but none of the LP-100 surfactant, removed none of the ink contaminants at either 120° F. or at 160° F. Thus, the Example C solution had much better ink-removing abilities than did the Example A solution which contained half-as-much of the 151-C surfactant. However, the ink-removing abilities of the Example C solution were not as good as those of the Example 1 solution, which, as stated hereinabove contained 1.00% by weight of the 151-C surfactant in combination with 2.50% by weight of the LP-100 surfactant and removed 100% by weight of the ink contaminants at both 120° F. and 160° F.

The Example D solution, which contained 5.00% by weight of the LP-100 surfactant and no amount of the 151-C surfactant, removed 75% by weight of the ink contaminants at both 120° F. and 160° F. The Example D solution had better ink-removing abilities than did the Example B solution which contained half-as-much of the LP-100 surfactant, specifically 2.50% by weight. The Example B solution only removed 50% of the ink contaminants at 120° F. and 160° F. However, even though the ink-removing abilities of the Example D solution were greater than those of the Example B solution, they were not as good as the ink-removing abilities of the Example 1 solution, which, like the Example B solution, contained 2.50% by weight of the LP-100 surfactant but which, unlike the Example B solution, also contained 1.00% by weight of the 151-C surfactant.

Figure 2:
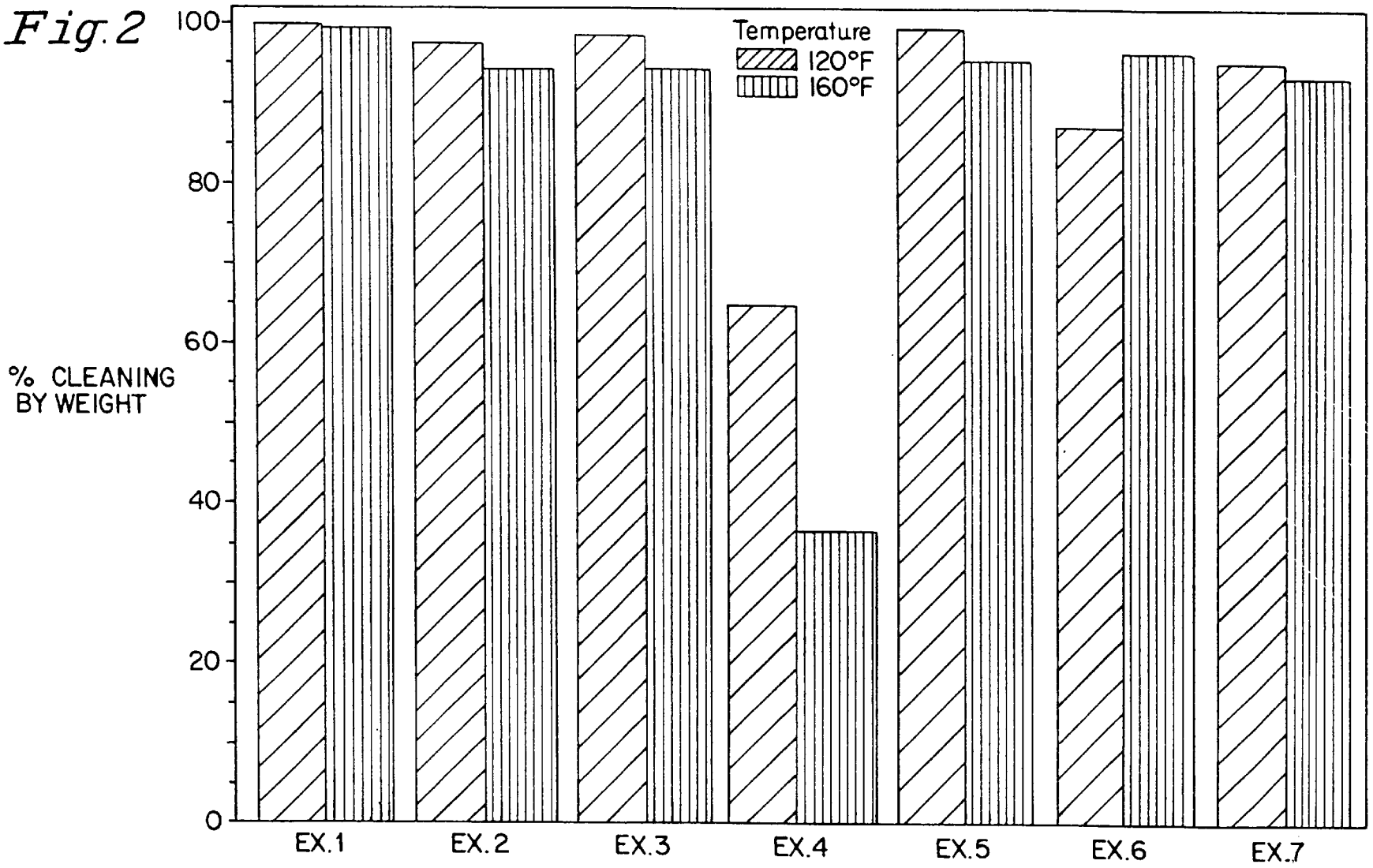
FIG. 2 is a graph showing the amount of grease contaminants removed from a metal substrate by means of the aqueous cleaning compositions prepared in Examples 1–3 and Comparison Examples A–D herein.

The grease-removing results for the solutions prepared in Examples 1–3 and Comparison Examples A–D are set forth in Table III and in FIG. 2.

TABLE III

Examples 1–3 and Comparison Examples A–D: Grease Removal Results

| | % Weight Removal | |
|---|---|---|
| Example No. | 120° F. | 160° F. |
| 1 | 99.9 | 99.5 |
| 2 | 97.5 | 94.1 |
| 3 | 98.5 | 94.3 |
| A | 64.6 | 36.4 |
| B | 99.3 | 95.6 |
| C | 87.2 | 96.5 |
| D | 95.5 | 93.3 |

As can be seen from Table III and FIG. 2, the LP-100 and 151-C surfactants at an LP-100:151-C active-concentration ratio of 2.5:1 have a synergistic effect on the cleaning solution's ability to remove grease. The Example A solution, containing 1.0% by weight of the 151-C surfactant and none of the LP-100 surfactant, removed 64.6% by weight of the grease contaminants at 120° F. and 36.4% by weight at 160° F. The Example B solution, containing 2.5% by weight of the LP-100 surfactant and none of the 151-C surfactant, removed 99.3% by weight of the grease contaminants at 120° F. and 95.6% by weight at 160° F. However, the Example 1 solution, which contained 2.5% by weight of the LP-100 surfactant and 1.0% by weight of the 151-C surfactant, removed 99.9% by weight of the grease contaminants at 120° F. and 99.5% by weight at 160° F. Thus, the percentage of grease contaminants removed by the Example 1 solution did not lie between the percentages of grease contaminants removed by the Example A and B solutions but instead was higher than the percentages of grease removed by the Example A and Example B solutions. Thus, Table III shows that the LP-100 and 151-C surfactants at an LP-100:151-C surfactant active-concentration ratio of 2.5:1 has some impact on the cleaning solution's ability to remove grease contaminants from metal substrates.

The Example 2 solution, which contained 2.50% by weight of the LP-100 surfactant and 0.50% by weight of the 151-C surfactant (i.e., an LP-100:151-C surfactant active-concentration ratio of 5.0:1), removed 97.5% by weight of the grease at 120° F. and 94.1% by weight of the grease at 160° F. Although the Example 2 solution did not remove as much of the grease contaminants as did the Example 1 solution, the Example 2 solution still displayed excellent grease-removing abilities.

The Example 3 solution, which contained 2.50% by weight of the LP-100 surfactant and 2.50% by weight of the 151-C surfactant (i.e., an LP-100:151-C surfactant active-concentration ratio of 1:1), removed 98.5% by weight of the grease contaminants at 120° F. and 94.3% by weight of the grease contaminants at 160° F. Thus, the Example 3 solution also had excellent grease-removing abilities.

The Example C solution, which contained 2.00% by weight of the 151-C surfactant but none of the LP-100 surfactant, removed 87.2% by weight of the grease contaminants at 120° F. and 96.5% by weight of the grease contaminants at 160° F. Thus, the Example C solution had much better grease-removing abilities than did the Example A solution which contained half-as-much of the 151-C surfactant, i.e., 1.00% by weight of the 151-C surfactant. However, the grease-removing abilities of the Example C solution were inferior to those of the Example 1 solution, which contained 1.00% by weight of the 151-C surfactant in combination with 2.50% by weight of the LP-100 surfactant. As stated previously herein, the Example 1 solution removed 99.9% by weight of the grease contaminants at 120° F. and 99.5% by weight at 160° F.

The Example D solution, which contained 5.00% by weight of the LP-100 surfactant and no amount of the 151-C surfactant, removed 95.5% by weight of the grease contaminants at 120° F. and 93.3% by weight at 160° F. The Example D solution had lower grease-removing abilities than did the Example B solution which contained half-as-much of the LP-100 surfactant, specifically 2.50% by weight. However, the Example B solution in turn had lower grease-removing abilities than the Example 1 solution which contained 2.50% by weight of the LP-100 surfactant in combination with 1.00% by weight of the 151-C surfactant.

Figure 3:
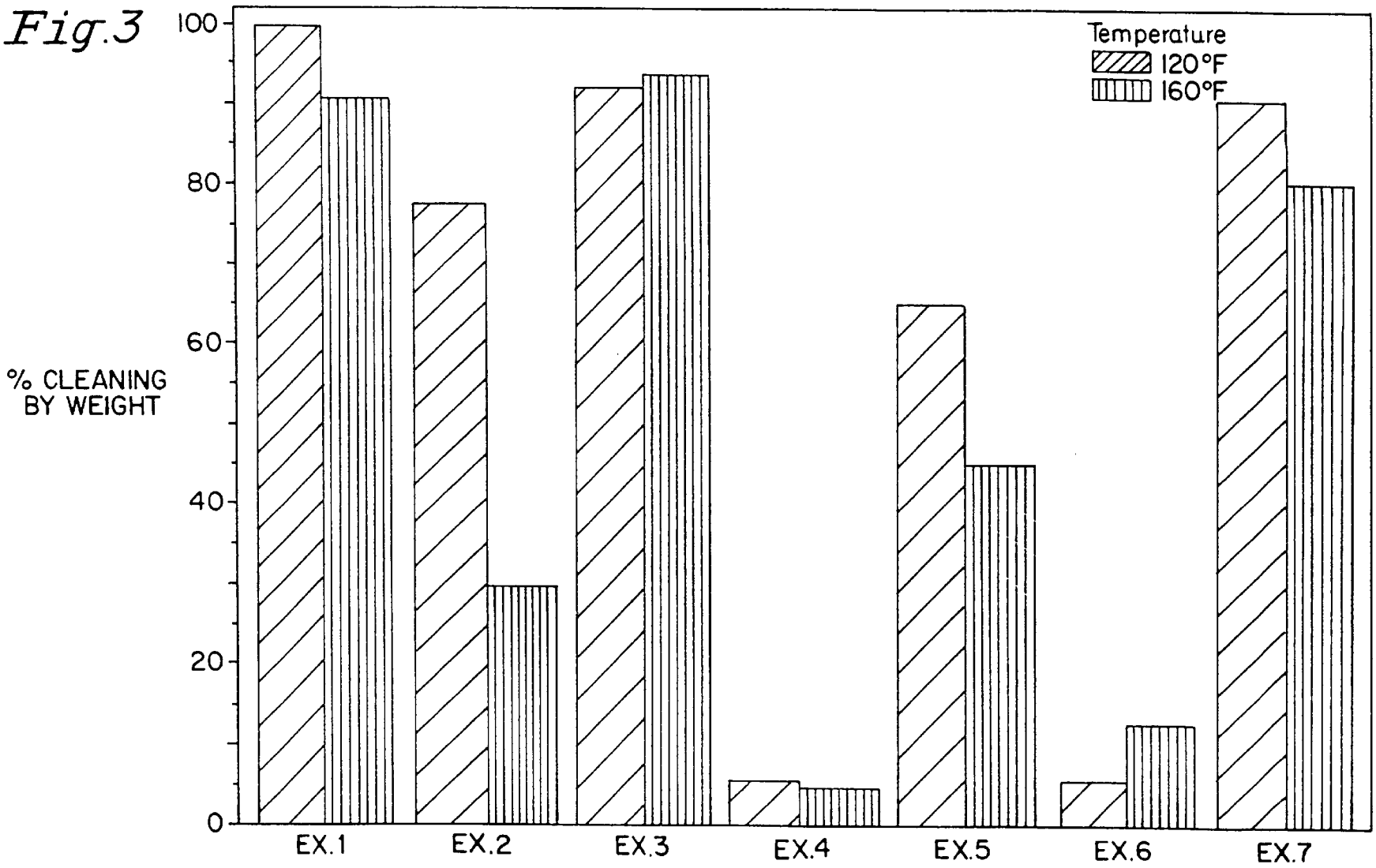
FIG. 3 is a graph showing the amount of mixed-lube contaminants removed from a metal substrate by means of the aqueous cleaning compositions prepared in Examples 1–3 and Comparison Examples A–D herein.

The mixed-lube-removing results for the solutions prepared in Examples 1–3 and Comparison Examples A–F are set forth in Table IV and in FIG. 3.

TABLE IV

Examples 1–3 and Comparison Examples A–F: Mixed-Lube Removal Results

| Example No. | % Weight Removal 120° F. | % Weight Removal 160° F. |
|---|---|---|
| 1 | 99.6 | 90.8 |
| 2 | 77.4 | 29.8 |
| 3 | 92.1 | 93.7 |
| A | 5.4 | 4.6 |
| B | 65.1 | 45.0 |
| C | 5.5 | 12.6 |
| D | 90.8 | 80.4 |
| E | 82.0 | 73.0 |
| F | 5.0 | 5.0 |

The results set forth in Table IV and FIG. 3 show that at an LP-100:151-C surfactant active-concentration ratio of 2.5:1, the LP-100 and 151-C surfactants also have a synergistic effect on the cleaning solution's ability to remove mixed-lube contaminants from metal surfaces. The Example A solution, containing 1.0% by weight of the 151-C surfactant and no LP-100 surfactant, removed 5.4% by weight of the mixed-lube contaminants at 120° F. and 4.6% by weight at 160° F. The Example B solution, containing 2.5% by weight of the LP-100 surfactant and no 151-C surfactant, removed 65.1% by weight of the mixed-lube contaminants at 120° F. and 45.0% by weight at 160° F. On the other hand, the Example 1 solution, containing 2.5% by weight of the LP-100 surfactant and 1.0% by weight of the 151-C surfactant, removed 99.6% by weight of the mixed-lube contaminants at 120° F. and 90.8% by weight of the contaminants at 160° F. Thus, the percentage of the mixed-lube contaminants removed by the surfactant combination was substantially higher than the percentages removed by the surfactants individually. Thus, Example 1 and Comparison Examples A and B show that at the LP-100:151-C surfactant active-concentration ratio of 2.5:1, the LP-100 and 151-C surfactants have a substantial synergistic impact on the cleaning solution's ability to remove mixed-lube contaminants from the metal coupon.

Example 1 and Comparison Examples E and F also show that the LP-100/151-C surfactant combination used in Example 1 has a synergistic effect on the mixed-lube-removing ability of the cleaning solution. The Example E solution, which contained 3.5% of the LP-100 surfactant but none of the 151-C surfactant, removed 82% of the mixed-lube contaminants at 120° F. and 73% of the mixed-lube contaminants at 160° F. The Example F solution, which contained 3.5% of the 151-C surfactant but none of the LP-100 surfactant, removed 5% of the mixed-lube contaminants at 120° F. and 5% of the mixed-lube contaminants at 160° F. As stated above, the Example 1 solution, which contained both the LP-100 surfactant and the 151-C surfactant, removed 99.6% of the mixed-lube contaminants at 120° F. and 90.8% of the mixed-lube contaminants at 160° F. Thus, the mixed-lube removing ability of the Example 1 solution is surprising in view of the mixed-lube-removing abilities of the Example E and F solutions. The Example 2 solution, which contained 2.50% by weight of the LP-100 surfactant and 0.50% by weight of the 151-C surfactant (i.e., an LP-100:151-C surfactant active-concentration ratio of 5.0:1), removed 77.4% by weight of the mixed lube at 120° F. and 29.8% by weight of the mixed lube at 160° F. Thus, the mixed-lube-removing abilities of the Example 2 solution were significantly inferior to those of the Example 1 solution, which also contained the LP-100 and 151-C surfactants but at a 2.5:1 active-concentration ratio.

The Example 3 solution, which contained 2.50% by weight of the LP-100 surfactant and 2.50% by weight of the 151-C surfactant (i.e., an LP-100:151-C surfactant active-concentration ratio of 1:1), removed 92.1% by weight of the mixed-lube contaminants at 120° F. and 93.7% by weight of the mixed-lube contaminants at 160° F. Thus, the Example 3 solution had excellent mixed-lube-removing abilities.

The Example C solution, which contained 2.00% by weight of the 151-C surfactant but none of the LP-100 surfactant, removed 5.5% by weight of the mixed-lube contaminants at 120° F. and 12.6% by weight of the mixed-lube contaminants at 160° F. Thus, the Example C solution had similar mixed-lube-removing abilities to those of the Example A solution which contained half-as-much of the 151-C surfactant, i.e., 1.00% by weight. However, the mixed-lube-removing abilities of the Example C solution were substantially inferior to those of the Example 1 solution, which contained 1.00% by weight of the 151-C surfactant in combination with 2.50% by weight of the LP-100 surfactant. As stated previously herein, the Example 1 solution removed 99.6% by weight of the mixed-lube contaminants at 120° F. and 90.8% by weight at 160° F.

The Example D solution, which contained 5.00% by weight of the LP-100 surfactant and no amount of the 151-C surfactant, removed 90.8% by weight of the mixed-lube contaminants at 120° F. and 80.4% by weight at 160° F. The Example D solution had better mixed-lube-removing abilities than did the Example B solution which contained half-as-much of the LP-100 surfactant, specifically 2.50% by weight. However, the Example D solution had lower mixed-lube-removing abilities than the Example 1 solution which contained 2.50% by weight of the LP-100 surfactant in combination with 1.00% by weight of the 151-C surfactant.

Thus, the results presented in Tables II–IV and FIGS. 1–3 show that the cleaning solution of the present invention using an LP-100:151-C surfactant active-concentration ratio of 2.5:1 (Example 1) had synergistically improved soil-removing abilities as compared to solutions containing the 151-C surfactant and LP-100 surfactant, individually (i.e., Examples A and B, respectively). The results further show that the solutions of Examples 2 and 3, which used different ratios of the LP-100:151-C surfactants, also had good metal-cleaning abilities. However, the results also show that the LP-100:151-C active-concentration ratio used in Example 1 (i.e., 2.5:1) produced better cleaning results than did the LP-100:151-C active concentration ratios used in Examples 2 and 3 (i.e., 5:1 and 1:1, respectively).

EXAMPLES 4–7 and COMPARISON EXAMPLES G–J

In Examples 4–7 and Comparison Examples G–J, eight (8) cleaning solutions were prepared, having the formulations set forth in Tables V–VIII below. In Tables V–VIII, the concentrations recited for the active ingredients represent the active concentrations of these ingredients.

TABLE V

Example 4 and Comparison Example G: Formulations

| Ingredient | Example No. (Active Concentration (Wt. %)) G | 4 |
|---|---|---|
| Distilled Water | 77.00 | 75.50 |
| Acrylic Acid Copolymer | 2.50 | 2.50 |
| NaOH Solution (50% solution) | 0.95 | 0.95 |
| Sodium Carbonate Monohydrate | 5.50 | 5.50 |
| Sodium Silicate | 1.80 | 1.80 |
| Cobratec TT-100 | 0.25 | 0.25 |
| Borax, 10 mole | 0.25 | 0.25 |
| Sodium Alkanoate Solution | 6.50 | 6.50 |
| LP-100 | 1.50 | 1.50 |
| 151-C | 0.00 | 1.50 |
| Alcodet 260 | 3.00 | 3.00 |
| Foam Blast | 0.75 | 0.75 |

TABLE VI

Example 5 and Comparison Example H: Formulations

| Ingredient | Example No. Active Concentration (Wt. %) H | 5 |
|---|---|---|
| Distilled Water | 70.55 | 68.55 |
| Acrylic Acid Copolymer | 1.00 | 1.00 |
| Belcor 577 | 1.00 | 1.00 |
| NaOH Solution (50 wt. %) | 1.00 | 1.00 |
| Sodium Carbonate | 2.50 | 2.50 |
| Sodium Bicarbonate | 0.25 | 0.25 |
| Sodium Silicate | 2.00 | 2.00 |
| Cobratec TT-100 | 0.30 | 0.30 |
| Borax, 10 mole | 0.30 | 0.30 |
| Sodium Alkanoate Solution | 10.00 | 10.00 |
| Nonidet SF-3 | 0.50 | 0.50 |
| Neodol 1-73B | 2.00 | 2.00 |
| Poly Tergent S 505 LF | 1.50 | 1.50 |
| LP-100 | 2.00 | 2.00 |
| 151-C | 0.00 | 2.00 |
| Plurafac LF 120 | 1.60 | 1.60 |
| Poly-Tergent E-17A | 1.50 | 1.50 |
| Poly-Tergent S 205LF | 1.50 | 1.50 |
| Pluronic L61 | 0.50 | 0.50 |

TABLE VII

Example 6 and Comparison Example I: Formulations

| Ingredient | Example No. Active Concentration (Wt. %) I | 6 |
|---|---|---|
| Distilled Water | 74.60 | 72.60 |
| Acrylic Acid Copolymer | 1.00 | 1.00 |
| Belcor 577 | 1.00 | 1.00 |
| KOH Solution (45 wt. %) | 1.00 | 1.00 |

TABLE VII-continued

Example 6 and Comparison Example I: Formulations

| Ingredient | Example No. Active Concentration (Wt. %) I | 6 |
|---|---|---|
| Potassium Carbonate | 6.00 | 6.00 |
| Potassium Silicate Solution | 2.00 | 2.00 |
| Cobratec TT-100 | 0.20 | 0.20 |
| Borax, 10 mole | 0.20 | 0.20 |
| Sodium Alkanoate Solution | 8.00 | 8.00 |
| Alcodet 260 | 1.00 | 1.00 |
| LP-100 | 2.00 | 2.00 |
| 151-C | 0.00 | 2.00 |
| Plurafac LF 1200 | 1.50 | 1.50 |
| Industrol DW-5 | 0.75 | 0.75 |
| Pluronic L61 | 0.75 | 0.75 |

TABLE VIII

Example 7 and Comparison Example J: Formulations

| Ingredient | Example No. Active Concentration (Wt. %) J | 7 |
|---|---|---|
| Distilled Water | 78.82 | 78.82 |
| Acrylic Acid Copolymer | 0.50 | 0.50 |
| Epsom Salts | 0.50 | 0.50 |
| Potassium Carbonate | 5.00 | 5.00 |
| Potassium Bicarbonate | 0.68 | 0.68 |
| Cobratec TT-100 | 0.20 | 0.20 |
| Borax, 10 mole | 0.20 | 0.20 |
| Sodium Alkanoate Solution | 8.60 | 8.60 |
| Alcodet 260 | 1.00 | 1.00 |
| LP-100 | 1.25 | 1.25 |
| 151-C | 0.00 | 1.25 |
| Plurafac LF 1200 | 1.00 | 1.00 |
| Poly Tergent SL-92 | 0.25 | 0.25 |
| Industrol DW-5 | 0.75 | 0.75 |

The ink-removal, grease-removal and mixed-lube-removal results for the solutions prepared in Examples 4–7 and Comparison Examples G–J are set forth in Tables IX, X and XI, respectively.

TABLE IX

Example 4–7 and Comparison Examples G–J: Ink Removal Results

| Example No. | Scale Value 120° F. | 160° F. |
|---|---|---|
| G | 1 | 1 |
| 4 | 0 | 1 |
| H | 0 | 1 |
| 5 | 1 | 1 |
| I | 1 | 2 |
| 6 | 1 | 2 |
| J | 0 | 1 |
| 7 | 0 | 1 |

TABLE X

Examples 4–7 and Comparison Examples G–J: Grease Removal Results

| Example No. | % Removed 120° F. | % Removed 160° F. |
|---|---|---|
| G | 98.5 | 95.0 |
| 4 | 98.9 | 93.5 |
| H | 94.8 | 87.3 |
| 5 | 98.1 | 87.4 |
| I | 99.4 | 97.3 |
| 6 | 96.3 | 93.9 |
| J | 51.7 | 65.8 |
| 7 | 52.7 | 47.6 |

TABLE XI

Examples 4–7 and Comparison Examples G–J: Mixed-Lube Removal Results

| Example No. | % Removed 120° F. | % Removed 160° F. |
|---|---|---|
| G | 5.2 | 48.1 |
| 4 | 12.0 | 4.4 |
| H | 1.3 | 0.9 |
| 5 | 4.3 | 5.2 |
| I | 0.4 | 4.3 |
| 6 | 0.6 | 15.0 |
| J | 3.7 | 2.5 |
| 7 | −0.6 | 3.7 |

The results presented in Tables IX, X and XI show that the addition of the 151-C surfactant to the commercial products of Comparison Examples G, H, I, and J so as to produce in the product an LP-100:151-C active-concentration ratio of 2.5:1 did not have any appreciable impact on the ink-removing, grease-removing or mixed-lube-removing properties of the commercial products.

EXAMPLE 8 and COMPARISON EXAMPLES K–O

In Example 8 and Comparison Examples K–O, six (6) aqueous cleaning solutions were prepared having the formulations set forth in Table XII below. The solution prepared in Example 8 is within the scope of the present invention. In Table XII, the term "LP-300" refers to an N-dodecyl pyrrolidone surfactant commercially available under the designation "ISP Surfadone LP-300". In addition, in Table XII, the concentrations recited for the active ingredients represent the active concentrations of these ingredients.

TABLE XII

Example 8 and Comparison Examples K–O: Formulations

| Ingredient | Example No. Active Concentration (Wt. %)) 8 | K | L | M | N | O |
|---|---|---|---|---|---|---|
| Water | 89.00 | 91.50 | 91.50 | 91.50 | 89.00 | 89.00 |
| Pot. Carb. | 1.00 | 1.00 | 1.00 | 1.00 | 1.00 | 1.00 |
| Pot. Bicarb. | 5.00 | 5.00 | 5.00 | 5.00 | 5.00 | 5.00 |

TABLE XII-continued

Example 8 and Comparison Examples K–O: Formulations

| Ingredient | Example No. Active Concentration (Wt. %)) 8 | K | L | M | N | O |
|---|---|---|---|---|---|---|
| LP-100 | 2.50 | 0.00 | 2.50 | 0.00 | 0.00 | 2.50 |
| LP-300 | 0.00 | 0.00 | 0.00 | 2.50 | 2.50 | 2.50 |
| 151-C | 2.50 | 2.50 | 0.00 | 0.00 | 2.50 | 0.00 |

The ink-removing, grease-removing and mixed-lube-removing abilities at 120° F. of the solutions prepared in Example 8 and Comparison Examples K–O are set forth in Table XIII below.

TABLE XIII

Example 8 and Comparison Examples K–O: Cleaning Results

| Example No. | Ink (120° F.) | Grease (120° F.) | Mixed Lube (120° F.) |
|---|---|---|---|
| 8 | 4 | 97.0 | 88.0 |
| K | 0 | 64.6 | 5.4 |
| L | 2 | 99.3 | 65.1 |
| M | 0 | 1.5 | 40.9 |
| N | 3 | 79.98 | 10.0 |
| O | 3 | 86.6 | 77.8 |

As can be seen from Table XIII, the Comparison Example K solution, which contained the 151-C surfactant but not the LP-100 surfactant, removed 64.6% by weight of the grease contaminants from the metal substrate. The Comparison-Example L solution, which contained the LP-100 surfactant but not the 151-C surfactant, removed 99.3% by weight of the grease contaminants. The Example 8 solution, which contained both the LP-100 and the 151-C surfactants, removed 97.0% by weight of the grease contaminants. Thus, the LP-100/151-C surfactant combination provided the Example 8 solution with excellent grease-removing abilities.

Table XIII also shows that the Comparison-Example K solution, containing the 151-C surfactant alone, removed none of the ink contaminants from the metal substrate, while the Comparison-Example L solution, containing the LP-100 surfactant alone, removed 50% by weight of the ink contaminants. However, the Example 8 solution, containing both surfactants at an LP-100:151-C active-concentration ratio of 2.5:1, removed 100% by weight of the ink contaminants. This result was clearly unexpected in view of the ink-removing results of Comparison Examples K and L. Thus, the surfactant combination used in Example 8 provided the solution therein with excellent ink-removing ability and did so synergistically.

As further shown in Table XIII, the Comparison-Example K solution, containing the 151-C surfactant alone, removed only about 5.4% by weight of the mixed-lube contaminants, while the Comparison-Example L solution, containing the LP-100 surfactant alone, removed 65.1% by weight of the mixed-lube contaminants. On the other hand, the Example 8 solution containing both surfactants at the LP-100:151-C surfactant active-concentration ratio of 2.5:1, removed 88.0% by weight of the mixed-lube contaminants. Thus, the solution containing the surfactant combination removed substantially more of the mixed-lube contaminants than either of the solutions containing the surfactants individually. Thus, the LP-100:151-C surfactant combination used in Example 8 synergistically provided the solution therein with excellent mixed-lube contaminant-removing ability.

Comparison of the cleaning results of Example 8 and Comparison Examples K–O further shows the importance of using in the cleaning composition of this invention the N-octyl-2-pyrrolidone surfactant as opposed to a different N-alkyl pyrrolidone surfactant. The Comparison-Example O solution, which contained LP-300 surfactant (active concentration of 2.5% by weight) as the sole surfactant therein, removed 75% by weight of the ink contaminants from the metal substrate, 79.98% by weight of the grease contaminants and 10.0% by weight of the mixed-lube contaminants. As mentioned hereinabove, the Comparison-Example K solution, containing the 151-C surfactant as the sole surfactant, removed none of the ink contaminants, 64.6% by weight of the grease contaminants and 5.4% by weight of the mixed-lube contaminants. The Comparison-Example M solution, which contained both the LP-300 surfactant and the 151-C surfactant at an LP-300:151-C active-concentration ratio of 2.5:1, removed none of the ink contaminants, removed 1.5% by weight of the grease contaminants and removed 40.9% by weight of the mixed-lube contaminants. Thus, use of the LP-300 surfactant in place of the LP-100 surfactant resulted in a cleaning solution having relatively poor ink-removing, grease-removing and mixed-lube-removing properties. However, as stated hereinabove, the Example 8 solution containing the LP-100 surfactant and the 151-C surfactant resulted in a cleaning solution having excellent cleaning abilities. Specifically, the Example 8 solution removed 100% by weight of the ink contaminants, 97.0% by weight of the grease contaminants and 88.0% by weight of the mixed-lube contaminants.

Furthermore, the LP-300 and 151-C surfactants exhibited no synergism relative to the removal of the ink and grease contaminants. Although these surfactants showed some synergism relative to removal of the mixed-lube contaminants (see Comparison Example M), the cleaning solution composed of these surfactants had relatively poor mixed-lube removing ability inasmuch as the solution only removed 40.9% by weight of the mixed-lube contaminants.

On the other hand, as pointed out previously herein, the LP-100 and 151-C surfactants exhibited synergism relative to the removal of the ink and mixed-lube contaminants. Although the LP-100 and 151-C surfactants appeared to not exhibit synergism relative to the removal of grease contaminants, the solution containing the LP-100/151-C surfactant combination (Example 8) had excellent grease-removing ability.

EXAMPLES 9–16 and COMPARISON EXAMPLES P–U

In Examples 9–16 and Comparison Examples P–U, fourteen (14) aqueous cleaning solutions were prepared, having the formulations and pH values set forth in Table XIV below. The solutions prepared in Examples 9–16 were within the scope of the present invention. In Table XIV, the concentrations recited for the active ingredients represent the active concentrations of these ingredients. The solutions prepared in Examples 9–16 each had an LP-100:151-C surfactant active concentration weight ratio of 2.5:1. The solutions prepared in Comparison Examples did not contain any of the 151-C surfactant.

TABLE XIV

Examples 9–16 and Comparison Examples P–U: Formulations and pH Values

| Ingredient | Example No. Concentration (Weight %) | | | |
|---|---|---|---|---|
| | 9 | 10 | 11 | 12 |
| Water | 89.0 | 89.0 | 95.0 | 89.0 |
| Pot. Carb. | 1 | 1 | 0 | 0 |
| Pot. Bicarb. | 5 | 5 | 0 | 0 |
| Pot. Phthalate | 0 | 0 | 0 | 5 |
| Citric Acid | 0 | 0 | 0 | 0 |
| NaOH | 0 | 0 | 0 | 1 |
| LP-100 | 2.5 | 2.5 | 2.5 | 2.5 |
| 151-C | 1.0 | 1.0 | 1.0 | 1.0 |
| pH | 10.2 | 10.2 | 6.3 | 4.9 |
| | 13 | 14 | 15 | 16 |
| Water | 89.0 | 89.0 | 89.0 | 89.0 |
| Pot. Carb. | 0 | 0.5 | 0 | 1 |
| Pot. Bicarb. | 0 | 5.5 | 6.0 | 5 |
| Pot. Phthalate | 0 | 0 | 0 | 0 |
| Citric Acid | 6 | 0 | 0 | 0 |
| NaOH | 0 | 0 | 0 | 0 |
| LP-100 | 2.5 | 2.5 | 2.5 | 2.5 |
| 151-C | 1.0 | 1.0 | 1.0 | 1.0 |
| pH | 2.4 | 9.2 | 8.3 | 10.25 |
| | P | Q | R | |
| Water | 97.5 | 91.5 | 91.5 | |
| Pot. Carb. | 0 | 0 | 0 | |
| Pot. Bicarb. | 0 | 0 | 0 | |
| Pot. Phthalate | 0 | 5 | 0 | |
| Citric Acid | 0 | 0 | 6 | |
| NaOH | 0 | 1 | 0 | |
| LP-100 | 2.5 | 2.5 | 2.5 | |
| 151-C | 0 | 0 | 0 | |
| pH | 6.3 | 5 | 2.4 | |
| | S | T | U | |
| Water | 91.5 | 91.5 | 89.0 | |
| Pot. Carb. | 0.5 | 0 | 1 | |
| Pot. Bicarb. | 5.5 | 6.0 | 5 | |
| Pot. Phthalate | 0 | 0 | 0 | |
| Citric Acid | 0 | 0 | 0 | |
| NaOH | 0 | 0 | 0 | |
| LP-100 | 2.5 | 2.5 | 2.5 | |
| 151-C | 0 | 0 | 0 | |
| pH | 9.2 | 8.3 | 10.25 | |

The ink-removing and mixed-lube-removing abilities at 140° F. of the solutions prepared in Examples 9–16 and Comparison Examples P–U are respectively set forth in Tables XV and XVI below. In Example 9, the substrate which was cleaned with the solution was composed of Lexan® polycarbonate. In Examples 10–16 and in Comparison Examples P–U, the substrate cleaned was Kovar® metal alloy (as in Examples 1–8 and Comparison Examples A–U).

TABLE XV

Examples 9–16 and Comparison Examples P–U: Ink-Removal Results

| Example No. | Scale Value |
|---|---|
| 9 | 1 |
| 10 | 4 |
| 11 | 1 |
| 12 | 2 |

TABLE XV-continued

| Examples 9–16 and Comparison Examples P–U: Ink-Removal Results | |
|---|---|
| Example No. | Scale Value |
| 13 | 4 |
| 14 | 4 |
| 15 | 2 |
| 16 | 4 |
| P | 1 |
| Q | 2 |
| R | 2 |
| S | 2 |
| T | 2 |
| U | 3 |

TABLE XVI

| Examples 9–16 and Comparison Examples P–U: Mixed-Lube Removal Results | |
|---|---|
| Example No. | % Removed |
| 9 | 79.12 |
| 10 | 97.78 |
| 11 | 35.99 |
| 12 | 14.89 |
| 13 | 21.59 |
| 14 | 74.15 |
| 15 | 82.71 |
| 16 | 96.01 |
| P | 52.05 |
| Q | 10.78 |
| R | 25.71 |
| S | 34.09 |
| T | 73.31 |
| U | 83.30 |

As can be seen from Tables XV and XVI above, the solution prepared in Example 9, wherein the pH was about 10.2 and the substrate was Lexan® polycarbonate, exhibited some ink-removing ability (25%) and very good mixed-lube-removing ability (79.12%).

The solution prepared in Example 10, wherein the pH was about 10.2 and the substrate was Kovar® metal alloy, exhibited both excellent ink-removing abilities (100%) and excellent mixed-lube-removing abilities (97.78%). The solution prepared in Comparison Example U, which had a pH of about 10.25 and contained no 151-C surfactant, had both good ink-removing abilities (75%) and good mixed-lube-removing abilities (83.30%), but not as good as those of the Example 10 solution which did contain the 151-C surfactant.

The solution prepared in Example 11, wherein the pH was about 6.3 and the substrate was Kovar® metal alloy, exhibited some ink-removing abilities (25%) and some mixed-lube-removing abilities (35.99%). The solution prepared in Comparison Example P, which had a pH of about 6.3 and contained no 151-C surfactant, had some ink-removing abilities (25%) and good mixed-lube-removing abilities (52.05%).

The solution prepared in Example 12, wherein the pH was about 4.9 and the substrate was Kovar® metal alloy, exhibited relatively good ink-removing abilities (50%) and some mixed-lube-removing abilities (14.89%). The solution prepared in Comparison Example Q, which had a pH of about 5 and contained no 151-C surfactant, had good ink-removing abilities (50%) and some mixed-lube-removing abilities (10.78%).

The solution prepared in Example 13, wherein the pH was about 2.4 and the substrate was Kovar® metal alloy, exhibited excellent ink-removing abilities (100%) and some mixed-lube-removing abilities (21.95%). The solution prepared in Comparison Example R, which had a pH of about 2.4 and contained no 151-C surfactant, had good ink-removing abilities (50%) and some mixed-lube-removing abilities (25.71%).

The solution prepared in Example 14, wherein the pH was about 9.2 and the substrate was Kovar® metal alloy, exhibited excellent ink-removing abilities (100%) and very good mixed-lube-removing abilities (74.15%). The solution prepared in Comparison Example S, which had a pH of about 9.2 and contained no 151-C surfactant, had good ink-removing abilities (50%) and some mixed-lube-removing abilities (34.09%).

The solution prepared in Example 15, wherein the pH was about 8.3 and the substrate was Kovar® metal alloy, exhibited good ink-removing abilities (50%) and very good mixed-lube-removing abilities (82.71%). The solution prepared in Comparison Example T, which had a pH of about 8.3 and contained no 151-C surfactant, had good ink-removing abilities (50%) and good mixed-lube-removing abilities (73.31%).

The solution prepared in Example 16, wherein the pH was about 10.25 and the substrate was Kovar® metal alloy, exhibited excellent ink-removing abilities (100%) and excellent mixed-lube-removing abilities (96.01%). The solution prepared in Comparison Example U, which had a pH of about 10.25 and contained no 151-C surfactant, had good ink-removing abilities (75%) and good mixed-lube-removing abilities (83.30%).

The results set forth in Tables XIV and XV show that at pH values of about 8.3 and higher, the solution within the scope of the invention wherein the LP-100:151-C surfactant active concentration weight ratio is 2.5:1.0, has mixed-lube-removing abilities which are better than those of a solution having the same pH but which does not contain any 151-C surfactant.

The results set forth in Tables XIV and XV also show that at pH values of about 9.2 and higher, the ink-removing abilities and mixed-lube-removing abilities of a solution within the scope of the invention wherein the LP-100:151-C surfactant active concentration weight ratio is 2.5:1.0 are much better than those of a solution having the same pH but which does not contain a 151-C surfactant.

What is claimed is:

1. An aqueous cleaning composition for cleaning a substrate contaminated with industrial-type soil contaminants, comprising:

(i) an aqueous portion and (ii) an active-ingredient portion comprising:

(A) an alkalinity-providing agent in an amount sufficient to provide said aqueous cleaning composition with an alkaline pH;

(B) a surfactant mixture comprising:

(a) an active concentration of an N-octyl-2-pyrrolidone surfactant, and (b) an active concentration of at least one aminocarboxylic acid surfactant of the general formula:

$$R—N(H)—R' \quad (I)$$

wherein R is a straight or branched chain aliphatic organic group having from 10 to 20 carbon atoms, and R' is a straight or branched chain carboxylic acid having from 2 to 10 carbon atoms;

wherein said active concentration of said surfactant (a) and said active concentration of said surfactant (b) are such as to render said aqueous cleaning composition capable of removing at least a substantial portion of said contaminants from said substrate.

2. A composition according to claim 1, wherein R comprises from 12 to 18 carbon atoms, and R' comprises from 2 to 4 carbon atoms.

3. A composition according to claim 1, wherein said aminocarboxylic acid surfactant is N-coco-beta-aminopropionic acid surfactant.

4. A composition according to claim 1, wherein said active concentration of said surfactant (a) and said active concentration of said surfactant (b) are such as to provide an active-concentration ratio of said surfactant (a) to said surfactant (b) of from about 5:1 to about 1:1.

5. A composition according to claim 1, wherein said active concentration of said surfactant (a) and said active concentration of said surfactant (b) are such as to provide an active-concentration ratio of said surfactant (a) to said surfactant (b) of about 2.5:1.

6. A composition according to claim 1, wherein said composition has a pH of less than about 12.0, further wherein said amount of said alkalinity-providing agent is such as to provide said composition with said pH of less than about 12.0.

7. A composition according to claim 1, wherein said composition has a pH of from about 8.0 to about 11.0, further wherein said amount of said alkalinity-providing agent is such as to provide said composition with said pH of from about 8.0 to about 11.0.

8. A composition according to claim 1, wherein said composition has a pH of from about 8.0 to about 10.0, further wherein said amount of said alkalinity-providing agent is such as to provide said composition with said pH of from about 8.0 to about 10.0.

9. A composition according to claim 1, wherein said alkalinity-providing agent is selected from the group consisting of alkali metal carbonates, alkali metal bicarbonates, and mixtures thereof.

10. A composition according to claim 9, wherein said alkalinity-providing agent is a mixture comprising potassium carbonate and sodium carbonate or a mixture comprising potassium carbonate and potassium bicarbonate.

11. A composition according to claim 1, wherein said composition is an aqueous concentrate comprising from about 55% to about 95% by weight of said aqueous portion and from about 5% to about 45% by weight of said active-ingredient portion.

12. A composition according to claim 1, wherein said composition is an aqueous solution comprising from about 80% to about 99.9% by weight of said aqueous portion and from about 0.1% to about 20% by weight of said active-ingredient portion.

13. A composition according to claim 1, wherein said cleaning composition comprises about 90% by weight of said aqueous portion and about 10% by weight of said active-ingredient portion.

14. A composition according to claim 1, wherein said active-ingredient portion comprises from about 20% to about 80% by weight of said alkalinity-providing agent, from about 80% to about 20% by weight of said surfactant mixture, from 0% to about 30% by weight of at least one hydrotrope, and from 0% to about 10% by weight of at least one anti-precipitating agent.

15. A composition according to claim 1, wherein said aqueous portion consists essentially of water.

16. A composition according to claim 1, wherein said composition is free of organic solvents.

17. A composition according to claim 1, wherein said substrate is a metal substrate.

18. A composition according to claim 1, wherein said substrate is a plastic substrate.

19. A non-aqueous, active-ingredient composition capable of being combined with an aqueous medium to form an aqueous cleaning composition for cleaning a substrate contaminated with industrial-type soil contaminants, said non-aqueous, active-ingredient composition comprising:

(A) an alkalinity-providing agent in an amount sufficient to provide said aqueous cleaning composition with an alkaline pH;

(B) a surfactant mixture comprising:

(a) an active concentration of an N-octyl-2-pyrrolidone surfactant, and (b) an active concentration of at least one aminocarboxylic acid surfactant of the general formula:

$$R—N(H)—R' \quad (I)$$

wherein R is a straight or branched chain aliphatic organic group having from 10 to 20 carbon atoms, and R' is a straight or branched chain carboxylic acid having from 2 to 10 carbon atoms;

wherein said active concentration of said surfactant (a) and said active concentration of said surfactant (b) are such as to render said aqueous cleaning composition capable of removing at least a substantial portion of said contaminants from said substrate.

20. A composition according to claim 19, wherein R comprises from 12 to 18 carbon atoms, and R' comprises from 2 to 4 carbon atoms.

21. A composition according to claim 19, wherein said aminocarboxylic acid surfactant is N-coco-beta-aminopropionic acid surfactant.

22. A composition according to claim 19, wherein said active concentration of said surfactant (a) and said active concentration of said surfactant (b) are such as to provide an active-concentration ratio of said surfactant (a) to said surfactant (b) of from about 5:1 to about 1:1.

23. A composition according to claim 19, wherein said active concentration of said surfactant (a) and said active concentration of said surfactant (b) are such as to provide an active-concentration ratio of said surfactant (a) to said surfactant (b) of about 2.5:1.

24. A composition according to claim 19, wherein said amount of said alkalinity-providing agent is such as to provide said aqueous cleaning composition with a pH of less than about 12.0.

25. A composition according to claim 19, wherein said alkalinity-providing agent is selected from the group consisting of alkali metal carbonates, alkali metal bicarbonates, and mixtures thereof.

26. A composition according to claim 25, wherein said alkalinity-providing agent is a mixture comprising potassium carbonate and sodium carbonate or a mixture comprising potassium carbonate and potassium bicarbonate.

27. A composition according to claim 19, wherein said composition comprises from about 20% to about 80% by weight of said alkalinity-providing agent, from about 80% to about 20% by weight of said surfactant mixture, from 0% to about 30% by weight of at least one hydrotrope, and from 0% to about 10% by weight of at least one anti-precipitating agent.

28. A surfactant mixture for use in an alkaline, aqueous cleaning composition containing an alkalinity-providing agent, said mixture comprising:

(a) an active concentration of an N-octyl-2-pyrrolidone surfactant, and (b) an active concentration of at least one aminocarboxylic acid surfactant of the general formula:

R—N(H)—R'(I)

wherein R is a straight or branched chain aliphatic organic group having from 10 to 20 carbon atoms, and R' is a straight or branched chain carboxylic acid having from 2 to 10 carbon atoms; wherein a ratio of said active concentration of said surfactant (a) to said active concentration of said surfactant (b) is such as to render said aqueous cleaning composition capable of removing at least a substantial portion of industrial-type soil contaminants from a substrate contaminated therewith.

29. A surfactant mixture according to claim 28, wherein R comprises from 12 to 18 carbon atoms, and R' comprises from 2 to 4 carbon atoms.

30. A surfactant mixture according to claim 28, wherein said aminocarboxylic acid surfactant is N-coco-beta-aminopropionic acid surfactant.

31. A surfactant mixture according to claim 28, wherein said active-concentration ratio of said surfactant (a) to said surfactant (b) is from about 5:1 to about 1:1.

32. A surfactant mixture according to claim 28, wherein said active-concentration ratio of said surfactant (a) to said surfactant (b) is about 2.5:1.

33. A method for cleaning a substrate contaminated with industrial-type soil contaminants, comprising the steps of:

(1) providing an aqueous cleaning composition comprising:

(i) an aqueous portion and (ii) an active-ingredient portion comprising:

(A) an alkalinity-providing agent in an amount sufficient to provide said composition with an alkaline pH; and (B) a surfactant mixture comprising:

(a) an active concentration of an N-octyl-2-pyrrolidone surfactant, and (b) an active concentration of at least one aminocarboxylic acid surfactant of the general formula:

R—N(H)—R' (I)

wherein R is a straight or branched chain aliphatic organic group having from 10 to 20 carbon atoms, and R' is a straight or branched chain carboxylic acid having from 2 to 10 carbon atoms;

wherein said active concentration of said surfactant (a) and said active concentration of said surfactant (b) are such as to render said aqueous cleaning composition capable of removing at least a substantial portion of said contaminants from said substrate; and (2) contacting said contaminated substrate with said aqueous cleaning composition for a period of time sufficient to remove at least said substantial portion of said contaminants from said substrate.

34. A method according to claim 33, wherein said substrate is a metal substrate.

35. A method according to claim 33, wherein said substrate is a plastic substrate.

36. A method according to claim 33, wherein said contacting of said contaminated substrate with said aqueous cleaning composition is carried out at a temperature of from about 90° F. to about 180° F.

37. A method according to claim 33, wherein said contacting of said contaminated substrate with said aqueous cleaning composition is carried out for period of from about 1 minute to about 30 minutes.

38. A method according to claim 33, wherein R comprises from 12 to 18 carbon atoms, and R' comprises from 2 to 4 carbon atoms.

39. A method according to claim 33, wherein said aminocarboxylic acid surfactant is N-coco-beta-aminopropionic acid surfactant.

40. A method according to claim 33, wherein said active concentration of said surfactant (a) and said active concentration of said surfactant (b) are such as to provide an active-concentration ratio of said surfactant (a) to said surfactant (b) of from about 5:1 to about 1:1.

41. A method according to claim 33, wherein said active concentration of said surfactant (a) and said active concentration of said surfactant (b) are such as to provide an active-concentration ratio of said surfactant (a) to said surfactant (b) of about 2.5:1.

42. A method according to claim 33, wherein said composition has a pH of less than about 12.0, further wherein said amount of said alkalinity-providing agent is such as to provide said composition with said pH of less than about 12.0.

43. A method according to claim 33, wherein said alkalinity-providing agent is selected from the group consisting of alkali metal carbonates, alkali metal bicarbonates, and mixtures thereof.

44. A method according to claim 33, wherein said alkalinity-providing agent is a mixture comprising potassium carbonate and sodium carbonate or a mixture comprising potassium carbonate and potassium bicarbonate.

45. A method according to claim 33, wherein said industrial-type soil contaminants comprise grease contaminants.

46. A method according to claim 33, wherein said industrial-type soil contaminants comprise ink contaminants.

47. A method according to claim 33, wherein said industrial-type soil contaminants comprise mixed-lube contaminants.

* * * * *